United States Patent [19]

Orlowski

[11] 4,158,543

[45] Jun. 19, 1979

[54] CLEANER FOR GRAIN AND SUEDE LEATHER

[76] Inventor: Jan A. Orlowski, 1304 Rubio Dr., Altadena, Calif. 91001

[21] Appl. No.: 874,766

[22] Filed: Feb. 3, 1978

[51] Int. Cl.[2] ..... C14C 11/00; B08B 3/00

[52] U.S. Cl. ..... 8/137; 8/94.13; 8/139; 8/142; 260/31.8 DR; 260/31.8 PQ; 260/32.6 A; 260/32.6 PQ; 260/33.6 UA; 260/33.8 UA

[58] Field of Search ..... 8/94.13, 137, 142, 139; 260/31.8 DR, 31.8 PQ, 33.6 UA, 33.8 UA, 32.6 PQ, 32.6 A

[56] References Cited

U.S. PATENT DOCUMENTS

| | | | |
|---|---|---|---|
| 2,161,504 | 6/1939 | Campbell | 8/94.13 |
| 2,481,933 | 9/1949 | Kirby et al. | 8/94.13 |
| 3,130,083 | 4/1964 | Turner | 8/94.13 |

*Primary Examiner*—A. Lionel Clingman

[57] ABSTRACT

Article and process for cleaning grain or suede leather surfaces. The process comprises rubbing over the surface to be cleaned a semi-solid article formed from a substantially uniform mixture of a rubber-type material, a liquid plasticizer/solvent for this material, and inorganic, finely divided particulate filler. An optional preferred ingredient is a thickener to reduce cold flow. Another optional preferred ingredient is a finely divided pigment to impart a uniform shade to the article. The article is formulated to be sufficiently yielding to avoid damage to the soiled surface of the material that is to be cleaned.

20 Claims, No Drawings

CLEANER FOR GRAIN AND SUEDE LEATHER

FIELD OF THE INVENTION

This invention is concerned with a process and article for cleaning the surface of a grain or suede leather. More particularly, the invention is concerned with an article that can be used to clean a soiled or spotted grain or suede leather surface by rubbing it over the surface as often as necessary to accomplish the desired cleaning.

BACKGROUND OF THE INVENTION

Leather articles, particularly leather garments, are often cleaned by processes that remove dirt and grease with an aqueous solution of soap, synthetic detergent, ammonia, or some other cleaning agent, or by treating the leather with an organic solvent. None of these techniques is completely satisfactory because each tends to have a deleterious effect on the leather.

Cleaning suede is a more difficult problems than cleaning leather, since suedes do not tolerate water. The commonly used methods for cleaning suede leather involve the use of petroleum-based solvents in a type of dry-cleaning process. Spot removal may be accomplished by the use of a chlorinated hydrocarbon, often applied in the form of a spray.

The problem of cleaning leather, without adversely affecting it, has been recognized for a long time. In U.S. Pat. No. 1,100,436, granted June 16, 1914, soiled gloves were placed in open mesh bags together with small sponges; immersed in a mixture of gasoline, caustic potash or ammonia, and a fatty acid such as oleic acid; and heated and tumbled in an inert atmosphere. The sponges produced a gentle, kneading action that cooperated with the solvent and rinsing action of the gasoline. Needless to say, such treatment would not only remove accumulated grease, dirt, perspiration, and stains, it would destroy the suppleness, resilience and hand of the leather, to say nothing of the fire hazard involved.

Bennett's The Chemical Formulary, Chemical Publishing Co., Vol. 1 (1933), p. 77, describes a leather cleaner made by dissolving soap in water, then adding ammonium hydroxide, glycerine, and ethylene dichloride. There are no directions for use, but clearly, the glycerine was added in the hope of compensating for the harsh action of the other materials. The same volume, on page 431, describes a suede cleaner made from a mixture of chalk, quilaya bark, cream of tartar, and oil birch tar. Once again, there are no directions for use of this suede cleaner preparation, or as a matter of fact, for the method of preparing it.

Later editions of Bennett's Formulary repeated substantially the same leather cleaner recipe that appeared in the 1933 edition above: see for example Vol. 5 (1941), at page 571, and Vol. 7 (1945), pages 373 and 374.

A somewhat different approach is described in U.S. Pat. No. 2,161,504, granted June 6, 1939. The patented invention there is based on the discovery that vulcanized oils are particularly suitable as an abrasive material for cleaning leather skins to produce a buffed surface. The patent points out that vulcanized oils are made by treating vegetable oils with sulfur chloride. For the purposes of the inventon, these vulcanized oils are reduced to particulate form, and then are placed in a drum together with the leather skins that are to be cleaned. The skins or other leather articles are then subjected to tumbling with the particulate vulcanized oil, to produce a mild abrasive action. The particles are then removed from the leather by brushing.

The Davis patent, U.S. Pat. No. 2,766,134, granted Oct. 9, 1956, faced a somewhat different problem. Davis was concerned with restoring the original appearance of leather that had been impregnated with a material such as rubber, oil, wax, of polymerized wood rosin. To effect the restoration, the impregnated leather was washed in a solvent, such as gasoline, for a period of time sufficient to dissolve only the impregnant immediately adjacent the surface of the impregnated leather, then the solvent was removed by washing with a second solvent miscible with the first solvent but inert to the leather, and then the impregnated leather was washed in water. Strictly speaking, this was not a cleaning technique but an attempt to remove an impregnant. Despite the presence of the impregnant, it is doubtful that the water washing step exerted any kind of beneficial effect on the leather.

A higher level of sophistication, in suede treatments, appears in U.S. Pat. No. 2,876,130, granted Mar. 3, 1959, where suede was treated, not to clean it, but to apply an optical brightening agent to brighten the appearance of the suede.

The usual kind of dry cleaning approach, for cleaning leather gloves, was described in the Bulletin Service of the National Institute of Dry Cleaning, May, 1959, pages 38 and 39. This bulletin, intended for professional use only, suggested the use of a mixture of dry cleaning detergent with several parts of dry cleaning solvent. The article pointed out that some detergents, when used in a wet stock solution, will not rinse completely from the leather and will leave a yellow stain. No suggestion was made for avoiding the problem other than checking with the manufacturer of the detergent to see whether any particular detergent would be suitable for use in this manner. Additional details on cleaning suede garments appeared in the same publication in its January, 1962 issue, page 51. This publication points out that the dry cleaning cycle may take anywhere from 15 to 35 minutes, in petroleum equipment, depending upon how dirty the suede garment is. Several extraction, rinse, and extraction steps are suggested, with tumbling being conducted at a temperature not over 140° F., to avoid shrinkage. The publication recognizes the great tendency of water to spot suede, and the possibility of the loss of dye in an area that is being cleaned by the "spotting" technique. The second paragraph in the article points out that the dry cleaner must explain to customers that leathers must not only be dry cleaned but also refinished to restore their original appearance. No comment is made about the need for restoring other qualities of the leather that may have been adversely affected by the dry cleaning operation.

At least as early as 1967, Bennett's Formulary had become more elaborate in its suggestions for leather cleaning compositions. In Vol. 13 (1967), at pages 392 and 393, the Formulary suggests a leather cleaning composition containing silicone oil, oleic acid, mineral spirits, water, and other ingredients that are identified by trademark only. Directions are provided for mixing the ingredients for the leather cleaner, and for using it. The cleaner is to be applied with a clean cloth, followed by buffing.

Although prior art solvent cleaning methods generally are or can be made effective for removing dirt, fading, stiffness and other poor effects, such as a loss of "hand", are usual concomitants of prior art cleaning methods. Moreover, heavily soiled spots present a special problem. They are very difficult or impossible to clean with water-based agents, and the use of organic solvents often leaves a ring much larger in area than the original spot. Suede leather will tolerate dry cleaning agents less well than grain leather, and repeated applications of organic solvents have pronounced negative effects on suede leather. Greasy spots are virtually impossible to clean on suede, especially spots that result from perspiration around the neck and around the cuffs.

Professional dry cleaning techniques offer the only effective approach for cleaning heavily soiled grain leather and suede, and the end results are often not satisfactory because of the undesirable effects of solvents on the materials.

BRIEF DESCRIPTION OF THE INVENTION

The present invention is an article and process for cleaning a grain or suede leather surface, even a heavily soiled surface, by rubbing the surface to be cleaned with a semi-solid article comprising a substantially uniform mixture of a rubber-type material, a liquid plasticizer/-solvent for the rubber-type material, and finely divided inorganic filler. Preferred optional ingredients include a pigment to impart a uniform shade, and a thickener to reduce or eliminate cold flow. These materials are compounded so that the article is soft enough so that it can be rubbed repeatedly over the surface to be cleaned, without damaging the surface. It must engage the soiled surface with a light, frictional action, and must not be hard or brittle. Preferably it is not sticky or slippery.

The precise formulation selected for use will depend at least in part upon the type of packaging that is to be used. If the article is to be sold in a case like a lipstick, the case may be designed to offer support to the article, and it may be compounded to be softer than otherwise. If the article is to be sold in a package that is not supportive, then it must be compounded to be firm and self-supporting.

DETAILED DESCRIPTION OF THE INVENTION

An article prepared for use in accordance with the present invention is composed of a rubber or rubber-type compound, a particulate filler, and a liquid material that acts both as a plasticizer and solvent (to which the term, "a liquid plasticizer/solvent" is applied herein). These components are formed into a substantially uniform mixture in the proportions, by weight of the mixture, of 20% to 60% of the rubber, 10% to 50% of the filler, and 10% to 50% of the liquid plasticizer/solvent. The article should be prepared so that it is pliable, relatively soft, yet solid and cohesive.

The proportions and the ingredients should be selected so that the article is soft enough not to damage the surface of the leather or suede that is being cleaned, when it is rubbed over the soiled area. The rubbing action absorbs the dirt, grease and other soiling elements from the leather or suede, and is effective for cleaning, particularly for removing greasy spots and perspiration marks. The article should be compounded so that while flexible, pliable and soft, it is cohesive enough so that it does not leave an excessive amount of debris, and is economical in use.

The Rubber-Type Material

The rubber-type materials that are useful in making a cleaning article are preferably homopolymers or copolymers of monomers having at least four carbon atoms and two conjugated double bonds. Examples of such monomers are isoprene, butadiene, and chloroprene. These may be polymerized singly, or together with other olefinic materials such as isobutene, and the like.

Many types of rubber are satisfactory for use in the invention. Among others, the copolymers of butadiene and styrene have been generally found to be satisfactory. Copolymers of butadiene and acrylonitrile are also useful.

Vistanex, a rubbery material obtained by the polymerization of isobutylene in the presence of a catalyst, is a satisfactory rubber. Unlike natural rubber and many of the synthetics, it is a completely saturated polymer, but is a preferred material for the present invention. Another preferred material is butyl rubber, that is, a copolymer of isobutylene with a small amount of a diolefin such as isoprene. Natural rubber is also useful.

The rubber is ordinarily present in the cleaning article in an amount not less than 20% by weight of the article, but not more than 60% by weight of the article. When less than 20% by weight of rubber or rubber-type material is employed, the article tends to be brittle and often does not exhibit satisfactory cleaning power. Articles containing more than 60% of rubber-type material are difficult to handle because they are too resilient, and often exhibit too much friction when rubbed against the surface of a grain leather or suede leather item.

The preferred butyl rubbers and polyisobutylenes exhibit excellent characteristics with respect to picking up and absorbing dirt, oil, and grease. Articles prepared from these rubbers also have the ability to absorb ink spots such as those made by a ball point pen.

A particularly preferred rubber-type material is Vistanex L-100, a product of Exxon Chemical Company, which is a high molecular weight polyisobutylene (Staudinger molecular weight, 81,000–99,000). The high molecular weight polymer was selected because in general the molecular weight of the rubber-type material, the less the cold flow of the finished article. Another advantage is that generally, the higher the molecular weight, the less the cleaning article product tends to be sticky. Another preferred material is Vistanex MM-L-100, a somewhat similar polyisobutylene. The butyl rubber identified by its producer, Exxon, as Enjay butyl rubber No. 065, is another preferred material. Natural rubber may be used, but generally does not make as uniform a product as the synthetic polymers such as Vistanex L-100. Chlorobutyl rubber of the same molecular weight range as Vistanex L-100 is also a very useful material, but offers no advantage over Vistanex L-100.

The Liquid Plasticizer/Solvent

The primary purpose of the liquid plasticizer/solvent material is to render the rubber soft enough and flexible enough so that it can be safely, easily, and efficiently used for cleaning as intended. The material selected should have a boiling point, at atmospheric pressure, no lower than about 120° C., so as to minimize evaporation losses during storage.

The most suitable materials are the esters of aliphatic alcohols containing one through ten carbon atoms per molecule, with acids such as sebacic, phthalic, azelaic, and adipic acids. Thus, the preferred monomeric ester plasticizers are dioctyl adipate, di-isodecyl adipate, dioctyl sebacate, di(2-ethyl hexyl) azelate, dicyclohexyl phthalate, and the like. Other suitable materials are solvents such as xylene, tetralin, 1,2,4-trichlorobenzene and dimethylacetamide.

While dioctyl adipate is the preferred material, particularly for use with Vistanex L-100 polyisobutylene, low molecular weight polybutene, such as the Amoco product Polybutene L-14, is also useful, imparting the same pliability with slightly more tack. Paraffin oils also impart the same pliability but more tack than the low molecular weight polybutenes. When the paraffin oils are used, generally the higher the viscosity of the oil, the stiffer is the end product.

The amount of liquid plasticizer/solvent in the cleaning article should be no lower than about 10%, and generally no higher than about 50% by weight. Cleaning articles that contain less than 10% of the liquid plasticizer/solvent generally are too stiff for easy handling, and they do not have adequate cleaning power. Cleaning articles that contain more than about 50% of the liquid plasticizer/solvent are generally too soft and too sticky to be practical.

The Particulate Filler Material

The use of a finely divided filler material is essential to moderate the consistency of the article. It also makes the rubber less cohesive, and may exert a very mild abrasive action, thus producing the desired kind of action when the cleaning article is rubbed over a soiled surface. The most suitable filler materials are those inorganic finely divided particulate fillers having a particle size not exceeding about 100 microns and a hardness not exceeding 8 on Moh's scale. If the filler has a particle size above about 100 microns, and/or a hardness higher than about 8 on the Moh's scale, a tendency to abrade the soiled surface during cleaning may be observed.

Preferred finely divided fillers for use in the practice of the invention are calcium carbonate, calcium silicate, calcium phosphate, hydroxyapatite, barium sulphate, titanium dioxide, talc, and diatomaceous earth.

One particularly preferred material is Duramite calcium carbonate, sold by the John K. Bice Company. This material has a 10 micrometer mean particle size. It also has the lowest oil absorption characteristic of any of the common particulate inorganic filler materials. Other useful, low oil absorption calcium carbonates include Chem Carb 33, Chem Carb 55, and Chem Carb 66 of Engelhard Industries; Oolitic C of NL Industries; Omya Calibute of Pluess-Stauffer (North American) Inc.; No. 1 White of Thompson, Weinman & Co., and 1886 Duramite of Whittaker, Clark & Daniels, Inc. Other preferred materials include such low oil absorption fillers as No. 2 Natural Barytes of NL Industries; and BA-25 Barytes of Engelhard Industries.

The amount of particulate filler material in the cleaning article should be no less than 10% by weight of the article and no more than 50% by weight of the article. A cleaning article that contains less than 10% filler does not exhibit enough cleaning power, nor does it generate the proper kind of engagement and interaction between the cleaning article and the soiled surface. Cleaning articles that contain more than about 50% by weight of the filler are generally too brittle and do have enough cleaning power.

Other Components

The incorporation of a pigment in the cleaning article is desirable so that the article has an attractive appearance. Titanium dioxide is a preferred pigment material, since it imparts a pleasing white color to the product.

The DuPont product, Titanium Dioxide R-100, is a preferred material because it has a very low oil absorption characteristic. When a higher oil absorption material is employed, such as Titanium Dioxide No. 328 of Whittaker, Clark and Daniels, Inc. is used, the cleaning article produced tends to be somewhat stiffer.

To impart a white color, any suitable white pigment of low oil absorption may be used, such as zinc oxide, antimony oxide, zinc sulfide, and basic white lead carbonate. Titanium dioxide is preferred because it has the highest hiding power of any current commercially available white pigment. A rutile titanium dioxide is preferred because it has higher hiding power than the anatase type.

Since the titanium dioxide is finely divided and functions as a filler as well as a pigment, it may be replaced by calcium carbonate or other filler material where appearance or color of the cleaning article is not material, without impairment of the cleaning properties of the article.

If cost were of no consequence, all of the filler material could be replaced by low oil absorption, high hiding power pigment. In place of a white pigment, any other color pigment may be used. Color may also be imparted to the cleaning article by the use of dyes instead of pigments.

When the cleaning article is to be packaged in a package that does not provide physical support, cold flow must be avoided. For this purpose, a thickening agent should be incorporated.

The preferred thickener is a silica pyrogel. One preferred material is Cab-O-Sil M-5, a silica pyrogel having a particle size of about 14 micrometers. Cab-O-Sil EH-5, another pyrogel, having a particle size of about 7 micrometers, is also a preferred material. Both of these are products of Cabot Chemical Company. Silica aerogels are also effective. As reported by Cabot Corporation, the viscosity imparted by the use of one of its pyrogels is either not affected or is increased by replacing up to 20% by weight of the pyrogel with a polyfunctional short chain alcohol or amine, that is, one having less than 5 carbon atoms per molecule.

Generally, the silica aerogels are less effective in preventing cold flow than the pyrogels. The particle size of the silica pyrogel selected is not critical. The coarser particles are generally less effective in preventing cold flow, but the finer particle size silica pyrogels tend to be more expensive.

Fibrous materials such as wollastonite are also useful thickening agents for use in the practice of the invention.

Manufacturing Method

To make the cleaning article, any suitable technique can be employed that will produce a substantially uniform product.

One preferred technique for manufacturing the cleaning article involves milling the rubber-type material on previously warmed mill rolls, to masticate it until it is comparatively fluid. The filler and pigment are premixed with the liquid plasticizer/solvent to form a paste. This paste is then gradually added, a little at a time, to the rubber on the mill rolls, to permit thorough mixing until all of the paste has been added and a uniform, homogeneous composition has been obtained.

The temperature of the mill rolls may be regulated by the use of circulating water. Hot water can be used to pre-warm the rolls. Cold circulating water can then be used to prevent the rolls from becoming so hot, during mixing, that the material sticks. Any other intimate mixer can also be used effectively, including the Banbury mixer. This is a safer mixing machine than a mill roll stand, because the Banbury mixer is entirely enclosed. There is also less loss of the liquid plasticizer/-solvent by evaporation.

When a thickener is employed, it may be added on the mill roll or by gradual addition to the milled composition, using a Hobart mixer.

The invention will now be further described by reference to several specific demonstrations thereof, in which all parts and percentages are by weight unless expressly stated to be otherwise.

The following examples describe the production of cleaning articles that are satisfactory for cleaning soiled surfaces of grain leather and suede leather. The differences in composition between the several following examples produce different physical characteristics. However, all are satisfactory for their intended purpose.

Examples 1–3
Butyl Rubber - Dioctyl Adipate Formulations

| Example No.: | 1 | 2 | 3 |
|---|---|---|---|
| Ingredient: | % | % | % |
| Butyl rubber 065 (Exxon Chemical Company) | 33.6 | 47.5 | 38.0 |
| Dioctyl adipate | 24.0 | 33.5 | 25.0 |
| Duramite calcium carbonate | 34.4 | 16.5 | 30.0 |
| Titanium dioxide (R-100 DuPont) | 8.0 | 2.5 | 4.0 |
| Xylene | — | — | 3.0 |

These are made up on a two roll mill, following generally the procedure previously described for masticating the butyl rubber on warm rolls, the slowly adding a paste made up of the other ingredients, and continuing to work the material on the mill rolls until a homogeneous mass is obtained. At that point it is removed from the rolls. The mass may then be easily formed into any desired shapes for packaging.

The product of Example 1 should be packaged in a supportive container because it exhibits some cold flow. It is, however, a satisfactory cleaning article. A satisfactory product with less cold flow is produced when Vistanex L-100, a higher molecular weight material, is substituted for the butyl rubber, weight or weight, in the formulation of Example 1, with the other ingredients and their proportions remaining the same. The butyl rubber 065 of Examples 1–3 has a Staudinger molecular weight of 35,000–44,000, whereas Vistanex L-100 has a Staudinger molecular weight of 81,000–99,000. The higher molecular weight of the Vistanex L-100 leads to a marked decrease in cold flow properties and facilitates packaging.

Examples 1, 2 and 3 also demonstrate the effect of different quantities of inorganic particulate material. Example 2, which contains a relatively low amount of inorganic particulate material, is a more rubbery product than the others. Example 1 exhibits the firmest consistency because of its high filler content, and has a pleasing white appearance and a good consistency for its intended purpose.

Example 4
Polyisobutylene - di-n-hexyl azelate Formulation

| Ingredient: | % |
|---|---|
| Vistanex L-100 polyisobutylene (Exxon Chemical Co.) | 35 |
| Di-n-hexyl azelate | 25 |
| Calcium carbonate | 35 |
| Barium sulfate | 5 |

The azelate ester functioned as well as the adipate. This formulation for the cleaning article, like those of Examples 1, 2 and 3, is effective as a cleaner for suede leather and grain leather.

Examples 5–7
Additional Demonstrations
Of Butyl Rubber-Dioctyl Adipate
Formulations

| Example No.: | 5 | 6 | 7 |
|---|---|---|---|
| Ingredient: | | | |
| Butyl rubber 065 (Exxon Chemical Company) | 42.0 | 38.6 | 36.8 |
| Dioctyl adipate (Rohm & Haas L321) | 16.0 | 22.6 | 21.5 |
| Duramite calcium carbonate | 32.0 | 29.6 | 28.2 |
| Titanium dioxide (R-100, DuPont) | 10.0 | 9.2 | 8.7 |
| Wollastonite | — | — | 4.8 |

The cleaning article produced in Example 5 had good characteristics and was free of stickiness. The article of Example 6 was more pliable than that of Example 5 and was deemed to be of essentially the desired pliability and flexibility for a good product. When hot off the mill, it was sticky, but on cooling to room temperature, it became free of stickiness. It had a high degree of elasticity.

To make the article of Example 7, the same formulation was employed as in Example 6, with one modification. To 100 parts of the components used to formulate Example 6, in the same proportions used for Example 6, 5.0 grams of finely divided fibrous wollastonite was added. This was worked into the mixture and resulted in a cleaning article having excellent cleaning properties. It exhibited good characteristics as to cold flow, which apparently was minimized by the presence of the wollastonite thickener. The cleaning article of Example 7 was drier and even less sticky than that of Example 6. It was less elastic than the cleaning article of Example 6 and was essentially completely free of stickiness.

When 100 parts of the formulation of Example 6 was further modified by the addition of 5 parts of dioctyl adipate and an additional 10 parts of Duramite calcium carbonate, the article produced exhibited less cold flow than that of Example 6, and greater pliability.

This article was divided into samples and further modified by the addition of 5 parts, 10 parts, 15 parts, and 20 parts of wollastonite respectively, and of 1, 2, 5, 6 and 7½ parts respectively of silica pyrogel, Cab-O-Sil M5, having a particle size of about 14 micrometers. The wollastonite was considered to have a minimal effect upon cold flow properties, with very little difference between the specimens containing the different levels of wollastonite as to cold flow. However, the addition of the silica pyrogel at all levels reduced cold flow, the amount of cold flow observed in the article produced being minimal at the 6% level of addition of the pyrogel and zero at the 7½% level of addition of the pyrogel.

| Examples 8-10 Low Levels of Polyisobutylene - Preferred Embodiments | | | |
|---|---|---|---|
| Example No.: | 8 | 9 | 10 |
| Ingredient: | | | |
| Vistanex MM-L100 polyisobutylene | 25.0 | 22.8 | — |
| Vistanex L-100 | — | — | 29.3 |
| Dioctyl adipate | 27.6 | 28.3 | 26.1 |
| Duramite calcium carbonate | 31.8 | 32.7 | 29.8 |
| R-100 Titanium dioxide | 7.4 | 7.6 | 7.0 |
| Cab-O-Sil M5 silica pyrogel | 6.4 | 6.6 | 1.7 |
| Ethylene glycol | 1.8 | 1.9 | 6.1 |

These examples were made up with relatively low levels of polyisobutylene, to produce cleaning articles characterized by easier manipulation. The articles produced by these examples were satisfactory. Each was free from cold flow and was readily manipulable, and had a consistency that avoided damage to the surface being cleaned. The article produced by Example 9 was considered to have excellent cleaning ability on a specimen of suede fabric. The cleaning article of Example 8 was slightly more elastic.

EXAMPLES 11-13

Rubbers of Different Molecular Weights

The same composition was used for each of the three examples, but different rubbers were used. The following is the composition for the article of Example 11:

| Ingredient | Parts by Weight | Percentage by Weight |
|---|---|---|
| Butyl rubber, Exxon 065, approximate molecular weight 350,000 | 252.0 | 42.0 |
| Chevron No. 9 white petroleum oil | 72.0 | 12.0 |
| Dioctyl adipate | 24.0 | 4.0 |
| Purecal "O" calcium carbonate | 192.0 | 32.0 |
| Titanium dioxide | 60.0 | 10.0 |
| | 600.0 | 100.0 |

Example 12 was made from the same proportions but Polysar 101-3 butyl rubber with a molecular weight of approximately 425,000, was used as the rubber material.

Example 13 used the same proportions of ingredients, but the rubber was Vistanex L-100, having an approximate molecular weight of 1,000,000. (The molecular weights referred to in Examples 11-13 are weight average, based on viscosity measurements, furnished by the respective manufacturers.)

The articles produced by each of these examples had increasing stiffness in proportion to the molecular weight of the rubber used. The article of Example 11 had light tackiness, the article of Example 12 was tacky, and the article of Example 13 was free from tack. All three articles were useful for cleaning suede and grain leathers.

Other preferred formulations are described in the two examples following.

| Examples 14 and 15 Preferred Formulations | | |
|---|---|---|
| Example No. | 14 | 15 |
| Ingredient: | | |
| Vistanex MML-100 rubber | 23.0 | 22.8 |
| Dioctyl adipate | 28.3 | 28.4 |
| Calcium carbonate | 32.7 | 40.2 |
| Titanium dioxide | 7.4 | — |
| Microcrystalline silica | 6.6 | 6.6 |
| Ethylene glycol | 2.0 | 2.0 |

Cleaning articles prepared from these formulations give most satisfactory results and are about equal in performance.

General

In compounding rubber or rubber-type material with other ingredients to produce cleaning articles in accordance with the present invention, the materials should be selected so that the final article is soft so that it does not damage the surface being cleaned, and therefore it cannot be overly hard or brittle. It must engage the soiled surface softly, with a light cleansing action that apparently is partly due to mild abrasion and partly due to some kind of sorption. It is preferred to avoid stickness but not essential. Freedom from cold flow is important if the article is to be packaged in such a way that the package will not provide some degree of support for the article. These somewhat functional objectives make it difficult to specify with any degree of definiteness the kinds of materials that can be used.

As the molecular weight of the rubber-type material is increased, by selecting rubber or rubber-like materials of different molecular weights, where the other components and their proportions remain constant, the end product produced tends to be less and less sticky and also to become more and more stiff. Thus, a cleaning article made from Vistanex LM-MS, a liquid, medium soft polyisobutylene rubber, will have more tack and be less stiff than one made from butyl rubber 065, which in turn will be more tacky and less stiff than one made from Polysar 101-3 butyl rubber, or Vistanex L-100, these materials being named in order of increasing molecular weight.

The proper balance between the rubber-type material and the liquid plasticizer/solvent is important. These liquids plasticize the rubber-type material, to achieve the desired consistency. At the same time, they are solvents from the functional standpoint, because they help in removing spots by dissolving or softening them. When too much of the plasticizer/solvent is present, the end product is not useful, but is so soft as to be mushy, exhibiting poor coherence. When excessive amounts of plasticizer/solvent are present, clear liquid will separate out.

The amount of plasticizer/solvent employed is important for achieving optimum results. When the amount employed is toward the low end of the operative range of 10% to 50% by weight of the article, the article may be so stiff and rigid that it is not easily manufactured and packaged, even though it may be operative for its intended purpose. However, it is believed that one skilled in the art, knowing the desired criteria, can readily produce satisfactory practical articles by following the teachings of the present invention.

The presence of the proper amount of particulate filler is quite important. When too little filler is used, the product is too flexible and is too difficult to handle to be practicable. In addition, an undue number of rubbing strokes are required to remove soil, and in addition, the manufacturing operation is unduly prolonged because of the longer time taken to mill in the plasticizer/solvent for uniform incorporation into the rubber.

The filler used should have an "equivalent particle size" lower than 100 micrometers. The term "equivalent particle size" is often used in describing the particle size of finely divided solids. It can be described as the diameter of an imaginary particle that corresponds to the weight average of all particles of the filler. The normal measurement technique involves determining the rate of sedimentation, the results being obtained in the form of a curve showing particle size distribution. The weight average is calculated from this curve, and also the diameter of an imaginary spherical particle having a mass corresponding to that of an average particle.

The expression "low oil absorption" has been used herein to characterize some of the fillers. Generally it is desirable to use a filler of as low absorbency as possible. Oil absorbency is determined according to ASTM method No. D281. Low oil absorbency calcium carbonate (Duramite) has an oil absorbency value of 5.5 as determined by this method.

While the invention has been illustrated by the use of liquid plasticizer/solvents such as dioctyl adipate used alone, or in combination with a material such as xylene as in Example 3, combinations of such materials can readily be used. For example, one suitable mixture of materials that is useful is a mixture of di-n-hexyl azelate and dioctyl adipate, in the amount of from about 35% to about 65% by weight of each respectively, to make a total of 100% of the plasticizer/solvent mixture.

Conclusion

While the invention has been disclosed herein by reference to the details of several preferred embodiments thereof, it is to be understood that this disclosure is intended in an illustrative sense rather than in a limiting sense, as it is contemplated that modifications in the formulation of the components and in their proportions will readily occur to those skilled in the art, within the spirit of the invention and within the scope of the appended claims.

What is claimed is:

1. A pliable, relatively soft, solid and cohesive article for cleaning a spotted or soiled surface of grain leather or suede leather, and that is formed from a uniform mixture of from about 20% to about 60% by weight of the article of a rubber-type material formed from a homopolymer or copolymer of a monomer selected from the group consisting of monomers having at least four carbon atoms and two conjugated double bonds, and isobutylene, from 10% to 50% by weight of the article of a liquid plasticizer/solvent for the rubber-type material, said plasticizer/solvent having a boiling point at atmospheric pressure no lower than about 120° C., and rendering the article soft and flexible for use, and from 10% to no more than 50% by weight of the article of finely divided inorganic particulate filler, said mixture being compounded so that the article is yielding on contact with the surface to be cleaned to avoid damage to the surface while permitting frictional engagement of the article therewith.

2. The article of claim 1 including a finely divided inorganic pigment to impart a uniform shade to the article.

3. The article of claim 1 including a thickener to prevent cold flow, comprising finely divided calcium silicate, calcium carbonate, or silica, in sufficient quantity so that the article is substantially free from cold flow.

4. The article of claim 3 wherein the thickener is colloidal-sized silica particles that constitute at least 7.5% by weight of the article.

5. The article of claim 3 wherein the thickener constitutes at least 6% silica pyrogel particles and at least 1.5% of a polyfunctional short chain alcohol or amine of less than five carbon atoms, both percentages being by weight of the article.

6. An article in accordance with claim 1 wherein the filler has a hardness lower than 8 on Moh's scale.

7. An article in accordance with claim 1 wherein the rubber-type material is a polymer or copolymer of isoprene, butadiene, or chloroprene, or a copolymer of isobutylene.

8. An article in accordance with claim 7 wherein the liquid plasticizer/solvent is an ester of an aliphatic alcohol containing one to ten carbon atoms per molecule with an organic carboxylic acid.

9. An article in accordance with claim 7 wherein the liquid plasticizer/solvent is selected from the group consisting of xylene, tetralin, 1,2,3-trichlorobenzene and mixtures thereof.

10. An article in accordance with claim 6 wherein the particulate filler is an inorganic salt having an equivalent particle size less than 100 micrometers.

11. A pliable, relatively soft, solid and cohesive article for cleaning a soiled surface of grain leather or suede by rubbing it over the surface as needed, as often as needed, said article being formed from a rubber-type material formed from a homopolymer or copolymer of a monomer selected from the group consisting of monomers having at least four carbon atoms and two conjugated double bonds, and isobutylene, and a plasticizer/solvent for this material, said plasticizer/solvent having a boiling point at atmospheric pressure, no lower than about 120° C., in the relative proportions to each other from 20 to 60 parts by weight of rubber-type material to from 40 to 80 parts by weight of the liquid plasticizer/solvent, a finely divided inorganic particulate filler, and a sufficient amount of a thickener so that the article is essentially free from cold flow, all in a substantially uniform mixture, said mixture being formulated so that the article is sufficiently yielding on contact with the surface to be cleaned to avoid damage to that surface while permitting frictional passage thereover for cleaning.

12. An article in accordance with claim 11, wherein the percentages by weight of the mixture are from 20% to 50% of the rubber-type material, from 10% to 45% by weight of the liquid plasticizer/solvent for this material, from 25% to 45% of the finely divided inorganic particulate filler, and up to 10% of an inorganic pigment to impart a uniform shade to the article.

13. The article of claim 12 wherein the proportions are from 20% to 35% of the rubber-type material, from 20% to 35% of the liquid plasticizer/solvent, from 25% to 35% of the particulate filler, from 5% to 10% of the inorganic pigment, and wherein the thickener comprises colloidal-sized particulate silica.

14. The article of claim 13 wherein the rubber-type material is a butyl rubber or a polyisobutylene.

15. The article of claim 13 wherein the liquid plasticizer/solvent is dioctyl adipate.

16. The article of claim 13 wherein the filler is calcium carbonate.

17. An article in accordance with claim 13 comprising a uniform mixture of, in percentages by weight based on the mixture, from 20% to 35% polyisobutylene, from 20% to 35% of dioctyl adipate, from 25% to 35% of calcium carbonate, from 5% to 10% of titaniumdioxide pigment, and, as the thickener, at least 6% by weight of silica pyrogel and at least 1.5% by weight of ethylene glycol.

18. A process for cleaning a soiled surface of grain or suede leather comprising rubbing the surface to be cleaned with an article in accordance with claim 1, and repeating the step as necessary for cleaning the surface.

19. A process for cleaning a soiled surface of grain or suede leather comprising rubbing the surface to be cleaned with an article in accordance with claim 11, and repeating the step as necessary for cleaning the surface.

20. The process for cleaning the soiled surface of grain or suede leather comprising rubbing the surface to be cleaned with an article in accordance with claim 17, and repeating the step as necessary for cleaning the surface.

* * * * *